US006445117B1

(12) United States Patent
Miyamoto et al.

(10) Patent No.: US 6,445,117 B1
(45) Date of Patent: Sep. 3, 2002

(54) CATHODE RAY TUBE HAVING AN INTERNAL VOLTAGE-DIVIDER RESISTOR

(75) Inventors: Satoru Miyamoto; Kazunari Noguchi, both of Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/516,161

(22) Filed: Feb. 29, 2000

(51) Int. Cl.[7] ..... H01J 29/48
(52) U.S. Cl. ..... 313/417; 313/414; 315/3
(58) Field of Search ..... 313/412, 414, 313/417, 43, 479, 449, 451; 315/3, 382.1, 381, 382, 15, 16; 338/308

(56) References Cited

U.S. PATENT DOCUMENTS

| | | | | |
|---|---|---|---|---|
| 4,786,842 A | * | 11/1988 | Shimoma et al. | 313/417 |
| 5,914,559 A | * | 6/1999 | Muchi et al. | 313/414 |
| 6,005,472 A | * | 12/1999 | Mitsuhashi | 338/308 |
| 6,011,349 A | * | 1/2000 | Amano et al. | 313/417 |
| 6,294,872 B1 | * | 9/2001 | Tsuruoka et al. | 313/402 |
| 6,356,021 B2 | * | 3/2002 | Irikura et al. | 313/449 |

* cited by examiner

*Primary Examiner*—Ashok Patel
*Assistant Examiner*—Karabi Guharay

(74) *Attorney, Agent, or Firm*—Antonelli, Terry, Stout & Kraus, LLP

(57) ABSTRACT

A cathode ray tube includes an electron gun having a cathode, first and second grid electrodes, plural focus electrodes and an anode electrode fixed by two glass beads; a voltage-dividing resistor attached to one glass bead for producing an intermediate voltage applied to a first one of the plural focus electrodes adjacent to the anode electrode by dividing an anode voltage and a metal conductor attached to one of electrodes of the electron gun disposed upstream of the first one of the plural focus electrodes to surround the voltage-dividing resistor and the glass bead. The voltage-dividing resistor includes an overcoat insulating film, a resistance element and an insulating substrate stacked in the order named from the overcoat insulating film facing the glass bead, and the resistance element includes first-type resistance-forming regions disposed on opposite sides of the metal conductor and a second-type resistance-forming region containing a portion thereof facing the metal conductor. The resistance element in the first-type resistance-forming regions extends meanderingly in a direction of a tube axis, and the resistance element in the second-type resistance-forming region is configured such that minimum distances L1 and L2 between the resistance element and two long sides of the insulating substrate, respectively, are larger than corresponding minimum distances between the resistance element and two long sides of the insulating substrate in the first-type resistance-forming regions.

20 Claims, 13 Drawing Sheets

CATHODE RAY TUBE HAVING AN INTERNAL VOLTAGE-DIVIDER RESISTOR

BACKGROUND OF THE INVENTION

The present invention relates to a cathode ray tube, and in particular to a color cathode ray tube having an electron gun employing an internal voltage-dividing resistor.

Color cathode ray tubes used in TV receivers or information terminals, house an electron gun for emitting a plurality (usually three) of electron beams at one end of an evacuated envelope, a phosphor screen formed of phosphors coated on an inner surface of the evacuated envelope at the other end thereof for emitting light of a plurality (usually three) of colors, and a shadow mask which is closely spaced from the phosphor screen and serves as a color selection electrode. The electron beams emitted from the electron gun are deflected to scan the phosphor screen horizontally and vertically to form a rectangular raster by magnetic fields generated by a deflection yoke mounted externally of the evacuated envelope and display a desired image on the phosphor screen.

FIG. 12 is a cross-sectional view for explaining an exemplary configuration of a color cathode ray tube, and in FIG. 12. In this color cathode ray tube, an evacuated envelope is formed by a panel portion 1, a neck portion 2 and a funnel portion 3, and electron beams 16 emitted from an electron gun 9 housed in the neck portion 2 scan a phosphor screen 4 two-dimensionally by being subjected to horizontal and vertical deflection magnetic fields produced by a deflection yoke 10.

The electron beams 16 are modulated in amount by video signals supplied via stem pins 15, are color-selected by a shadow mask 5 disposed immediately in front of a phosphor screen 4, and impinge upon the phosphors of the corresponding primary colors to reproduce a desired color image. In FIG. 12, reference numeral 6 is a mask frame, 7 is a magnetic shield, 8 is a mask suspension mechanism, 11 is an internal conductive coating, 12 is a shield cup, 13 is a contact spring, and 14 is a getter.

Such cathode ray tubes employ a multistage focus lens system to obtain sufficiently small electron beam spots over the entire phosphor screen.

Japanese Patent Application Laid-open No. Hei 10-255682, for example, discloses an "extended field lens" serving as a main lens formed by disposing an intermediate electrode between an anode electrode and a focus electrode.

FIG. 13 is a schematic longitudinal cross-sectional view of an electron gun of a cathode ray tube disclosed in Japanese Patent Application Laid-open No. Hei 10-255682 and FIG. 14 is a cross-sectional view taken along line XIV—XIV of the electron gun shown in FIG. 13. The electron gun is of the extended field lens type comprising three equally spaced coplanar cathodes 309 (one for each electron beam), a first electrode 301, a second electrode 302, a third electrode 303, a fourth electrode 304, a 5-1st electrode (a focus electrode) 305, a 5-2nd electrode (a focus electrode) 306, an intermediate electrode 310, a sixth electrode (an anode electrode) 307 and a shield cup 308 arranged coaxially in the order named from the cathodes 309, and the cathodes and the electrodes are fixed in predetermined spaced relationship on a pair of glass beads 311.

A voltage-dividing resistor 312 fabricated on a ceramic substrate is housed within the cathode ray tube to obtain a voltage to be supplied to the intermediate electrode 310 within the cathode ray tube, and the voltage-dividing resistor 312 is fixed to one of the glass beads 311. A metal wire 314*a* surrounds the glass beads 311 and the voltage-dividing resistor 312 and is welded to the intermediate electrode 310 as shown in FIG. 14.

The electrons emitted from the cathodes 309 are focused by a prefocus lens formed by the cathodes 309, the first electrode 301, the second electrode 302 and the third electrode 303, next by a pre-main lens formed by the third electrode 303, the fourth electrode 304 and the 5-1st electrode 305, and then by a main lens formed by the 5-2nd electrode 306, the intermediate electrode 310 and the sixth electrode 307, onto a phosphor screen, and form an image on the viewing screen of the cathode ray tube.

The voltage applied to the intermediate electrode 310 is selected lower than an anode voltage, but higher than voltages applied to the focus electrodes by dividing the anode voltage using the voltage-dividing resistor 312. Provision of the intermediate electrode 310 forms a lens of the extended field type in which the potential distribution along the tube axis is made gentle from the anode electrode to the focus electrodes, reduces spherical aberration and consequently the diameter of the electron beam spots is reduced.

As shown in FIG. 14, the amount of electrical charges accumulated on the inner wall of a neck glass 317 is stabilized by attaching the metal wire 314*a* to the intermediate electrode 310 such that the metal wire 314*a* surrounds the glass bead 311 and the voltage-dividing resistor 312.

SUMMARY OF THE INVENTION

In the manufacture of a cathode ray tube, after the cathode ray tube has been exhausted of gases and sealed, so-called spot-knocking (high-voltage stabilization) of applying a high voltage of about twice the normal operating voltage for the cathode ray tube to its anode electrode is carried out to remove projections in electrodes of the electron gun or foreign particles within the cathode ray tube by forcing arcing between the electrodes and between the electrodes and the inner wall of the neck portion and to thereby prevent occurrence of arcing within the cathode ray tube during the normal operation of the completed cathode ray tube.

But, in a cathode ray tube employing the extended field lens formed by applying a voltage divided from the anode voltage using an internal voltage-dividing resistor to the intermediate electrode and the above-mentioned metal wire for suppression of discharge attached to and facing a focus electrode upstream of the intermediate electrode, when the spot-knocking of applying a high voltage of about 60 kV, for example, to the anode electrode is carried out with all the electrodes except for the anode electrode and the intermediate electrode being grounded, there has been a problem in that arcing occurs between the metal wire for suppression of discharge and the resistance element of the voltage-dividing resistor and consequently, an overcoat glass film covering a resistance element or an alumina ceramic substrate of the voltage-dividing resistor is often fractured, because the metal wire for suppression of discharge surrounding the voltage-dividing resistor is grounded and therefore a voltage difference of about 30 kV is produced between the metal wire and the resistance element.

It is an object of the present invention to provide a cathode ray tube incorporating an internal voltage-dividing resistor and having withstand voltage characteristics improved by heightening effects of spot-knocking sufficiently preventing fracture of the internal voltage-dividing resistor during the spot-knocking procedure.

A cathode ray tube in accordance with the present invention achieves the above object with the following representative configuration. A color cathode ray tube in accordance with the present invention is provided with a voltage-dividing resistor producing a voltage to be applied to one of focus electrodes of a focus lens for focusing an electron beam on a phosphor screen by dividing a voltage applied to an anode electrode and a metal conductor disposed to surround the voltage-dividing resistor for suppression of discharge. The voltage-dividing resistor comprises an overcoat insulating film, a resistance element and an insulating substrate stacked, and the resistance element comprises major resistance-forming regions disposed on opposite sides of the metal conductor where the resistance element extends meanderingly in a direction of a cathode ray tube axis, and another resistance-forming region containing a portion thereof facing the metal conductor where minimum distances L1 and L2 between the resistance element and two long sides of the insulating substrate extending in the direction of the cathode ray tube axis, respectively, are made larger than corresponding minimum distances between the resistance element and two long sides of said insulating substrate extending in the direction of the cathode ray tube axis in the major resistance-forming regions.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

Figure 1:
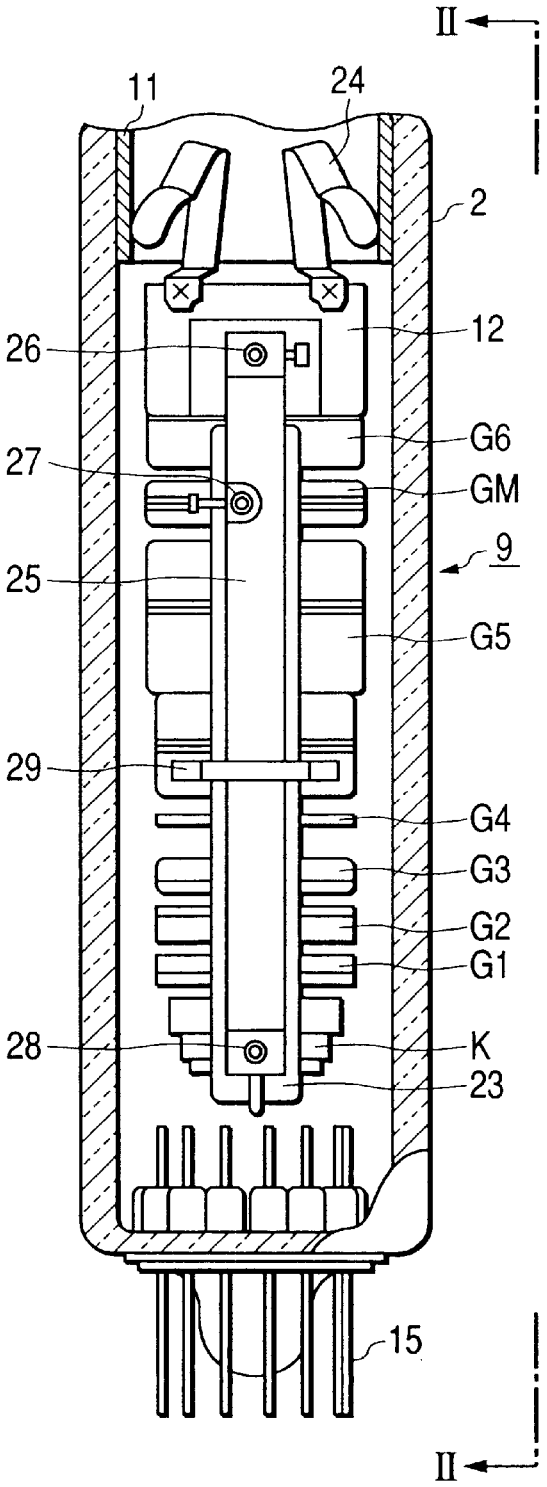
FIG. 1 is a partially broken-away front view of an embodiment of a color cathode ray tube according to the present invention.

The detailed explanation will be given to the embodiments according to the present invention by reference to the drawings. Like reference numerals denote like or functionally similar parts throughout the figures of the drawings.

Figure 2:
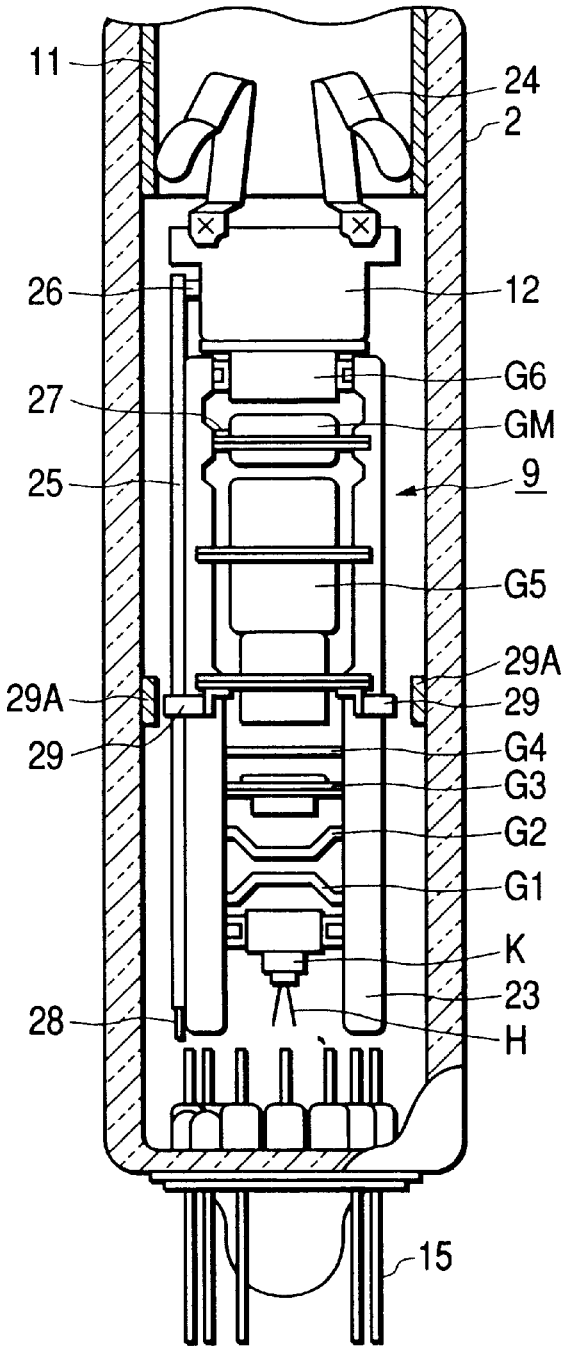
FIG. 2 is a partially broken-away side view of the color cathode ray tube taken along line II—II of FIG. 1.
Figure 3:
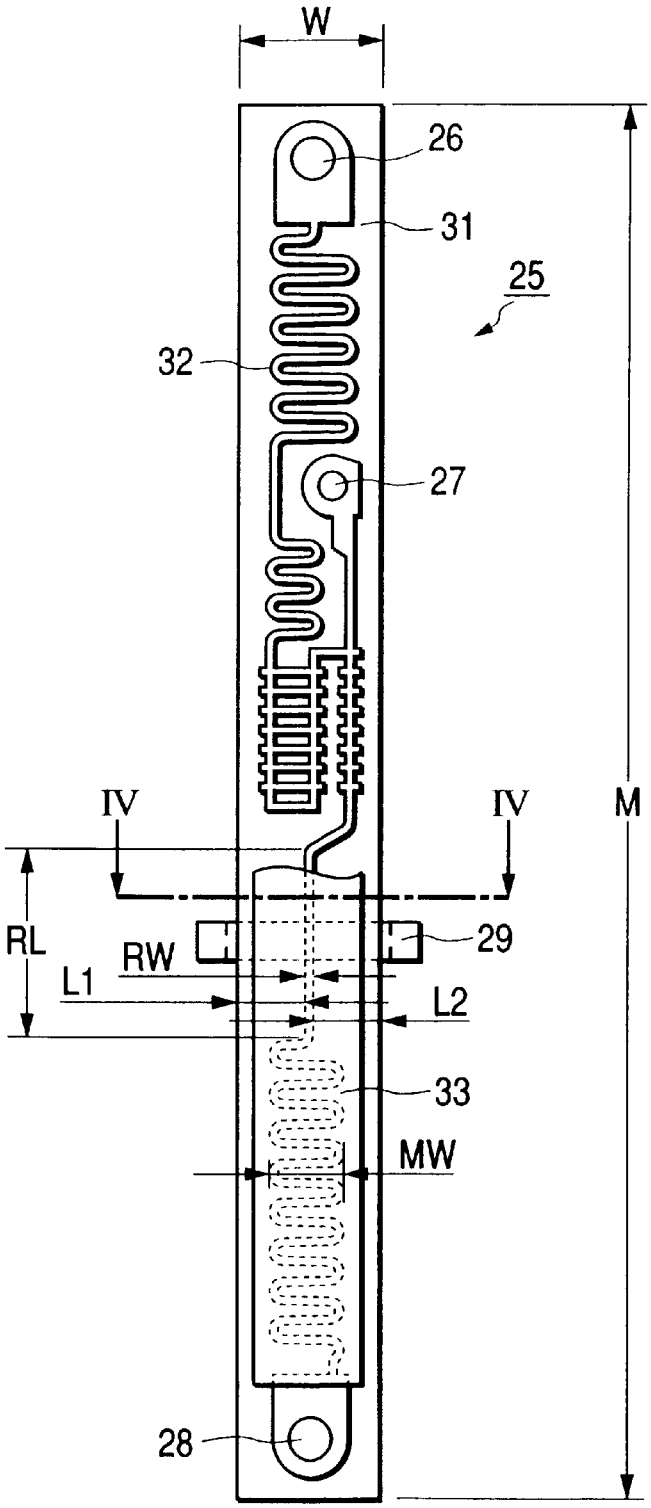
FIG. 3 is a partially broken-away top view of an embodiment of a voltage-dividing resistor used in the color cathode ray tube of the present invention.
Figure 4:
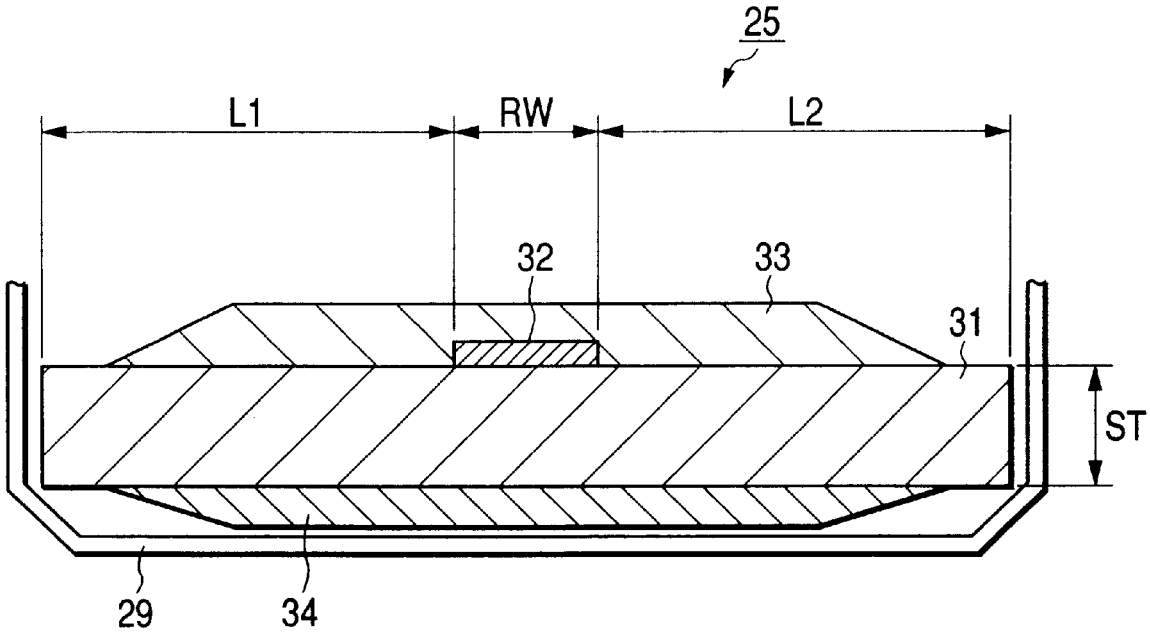
FIG. 4 is a cross-sectional view of the voltage-dividing resistor taken along line IV—IV of FIG. 3.

FIGS. 1 and 2 show the essential part of an electron gun for explaining a first embodiment of a color cathode ray tube according to the present invention, FIG. 1 being a partially cut-away front view of the color cathode ray tube and FIG. 2 being a partially cut-away side view of the color cathode ray tube taken along line II—II of FIG. 1. FIG. 3 is a partially broken-away top view of the voltage-dividing resistor 25 and FIG. 4 is a cross-sectional view of the voltage-dividing resistor 25 taken along line IV—IV of FIG. 3.

The three-beam in-line type electron gun 9 comprises a cathode K, a first grid electrode G1, a second grid electrode G2, a third grid electrode G3, a fourth grid electrode G4, a fifth grid electrode G5, an intermediate electrode GM, and a sixth grid electrode G6. The first to sixth grid electrodes G1–G6 and the intermediate electrode GM are fixed on a pair of glass beads (multiform glass beads) 23 in the predetermined order by embedding peripheral flanges of the grid electrodes and the intermediate electrode or support tabs attached to the grid electrodes and the intermediate electrode in a pair of glass beads 23. Bulb spacers 24 attached to a shield cup 12 contact an internal conductive coating 11 at their tips and center the axis of the electron gun 9 within the neck portion 2. The electron gun 9 is supported on stem pins 15 directly or via leads (not shown) and the cathodes K are heated by the heaters H contained in the cathodes K.

The internal voltage-dividing resistor 25 is mounted on the side of the glass bead 23 facing the neck portion 2 such that the side of the ceramic substrate of the internal voltage-dividing resistor 25 on which the resistance element 32 is formed faces toward the glass bead 23, that is, the overcoat glass film 33 faces the glass bead 23. A high-voltage terminal 26 of the internal voltage-dividing resistor 25 is connected to a shield cup 12 attached to the sixth grid electrode G6, an intermediate-voltage terminal 27 is connected to the intermediate electrode GM, and a low-voltage terminal 28 is grounded via one of the stem pins 15.

A shield wire 29 for suppression of discharge is disposed to surround the internal voltage-dividing resistor 25 and one of the glass beads 23 mounting the resistor 25 and is connected to the fifth grid electrode G5. The shield wire 29 for suppression of discharge can be made from nickel, stainless steel or the like.

A conductive film 29A for suppression of discharge shown in FIG. 2 is formed on the inner wall of the neck portion 2 by evaporating a portion of metal contained in the shield wire 29 onto the inner wall of the neck portion 2 heating the shield wire 29 using a high-frequency induction heater (not shown) external to the neck portion 2 after the spot-knocking step.

Next, an embodiment of the internal voltage-dividing resistor 25 of the present invention will be explained in detail. FIG. 3 is a partially broken-away top view of the voltage-dividing resistor 25 and FIG. 4 is a cross-sectional view of the voltage-dividing resistor 25 taken along line IV—IV of FIG. 3. A portion of the shield wire 29 for suppression of discharge are also shown in FIGS. 3 and 4.

The internal voltage-dividing resistor 25 comprises a resistance element 32 made chiefly of ruthenium oxide and formed on an alumina ceramic substrate 31, and the high-voltage terminal 26, the low-voltage terminal 28 and the intermediate-voltage terminal 27 disposed at two ends of the resistance element 32, at the point intermediate between the two ends, respectively. The resistance element 32 is covered with an overcoat glass film 33 (made of lead glass of 0.3 mm in thickness, for example), and the bottom surface of the ceramic substrate 31 is covered with an overcoat glass film 34 (made of lead glass of 0.2 mm in thickness, for example).

Generally, the overall length M and the width W of the internal voltage-dividing resistor 25 and the thickness ST of the ceramic substrate 31 are approximately in ranges of 50 mm to 100 mm, 5 mm to 10 mm and 0.6 mm to 1.0 mm, respectively.

In the present embodiment, as shown in FIG. 3, the resistance element 32 is of the shape of a straight line extending along the axis of the cathode ray tube in a region of the substrate 31 containing a portion thereof facing the shield wire 29 and having an axial length RL, and the width RW of the resistance element 32 in a direction perpendicular to the cathode ray tube axis is made narrower than the maximum width MW of meandering of the resistance element 32 in the remainder of the substrate 31. That is to say, in the region of the substrate 31 containing a portion thereof facing the shield wire 29 and having the axial length RL, the resistance element 32 is constricted without being meandered so as to prevent the fracture of the voltage-dividing resistor 25 during the spot-knocking procedure.

If a voltage difference of about 30 kV is assumed to be produced between the resistance element 32 and the shield wire 29 for suppression of discharge during the spot-knocking procedure, distances L1 and L2 between the resistance element 32 and the shield wire 29 need to be large enough to prevent electric breakdown therebetween at 30 kV thereacross. The distances L1 and L2 are values measured in the direction of the width W (the direction perpendicular to the tube axis) of the voltage-dividing resistor 25.

It can be thought that the dielectric strength of the ceramic substrate 31 is approximately 15 kV/mm, and therefore the distances L1 and L2 need to be approximately 30(kV)/15 (kV/mm)=2 mm, respectively.

The following explains a numerical example.

Assume that the thickness ST and the width W of the ceramic substrate 31 are 0.6 mm and 5 mm, respectively and the above value for the distances L1 and L2 are adopted. Then the width RW (see FIGS. 3 and 4) of the resistance element 32 in the region of the substrate 31 facing the shield wire 29 and its vicinities is RW =W−(L1+L2)=5−(2+2)=1 mm, and therefore the intended object is achieved by making the width RW equal to or less than 1 mm. Further, if the above-mentioned axial length RL of the region of the resistance element 32 containing a portion thereof facing the shield wire 29 is made at least 4 mm, there is obtained the advantage that occurrence of arcing between the resistance element 32 and the shield wire 29 is more securely prevented.

The internal voltage-dividing resistor 25 is housed in a limited space between the inner wall of the neck portion 2 and a glass bead 23 for supporting and fixing the electrodes of the electron gun within the cathode ray tube, and therefore it is required to be small-sized and highly reliable. To improve the reliability of the internal resistance element 32, it is necessary to secure a sufficient width of the resistance element 32, but, on the other hand, to obtain a sufficiently high resistance, it is also necessary to secure the sufficient overall length of the resistance element 32. Therefore, the resistance element 32 must be configured so as to meander on the ceramic substrate 31 extending approximately the full width of the ceramic substrate 31 as shown in FIG. 3, and consequently, the distances between the shield wire 29 and the resistance element 32 are reduced such that arcing occurs therebetween and the overcoat glass film 33 covering the resistance element 32 or the alumina ceramic substrate 31 has often been fractured.

In the present invention, however, as shown in FIG. 3, in the region of the resistance element 32 containing a portion thereof facing the shield wire 29 and having the axial length RL, by making the width RW of the resistance element 32 narrower in the direction perpendicular to the cathode ray tube axis than the maximum width MW of meandering of the resistance element 32 in the remainder thereof, the sufficient creepage distances L1 and L2 between the resistance element 32 and the shield wire 29 on the ceramic substrate 31 are secured to prevent the fracture of the voltage-dividing resistor 25 during the spot-knocking procedure.

Figure 5:
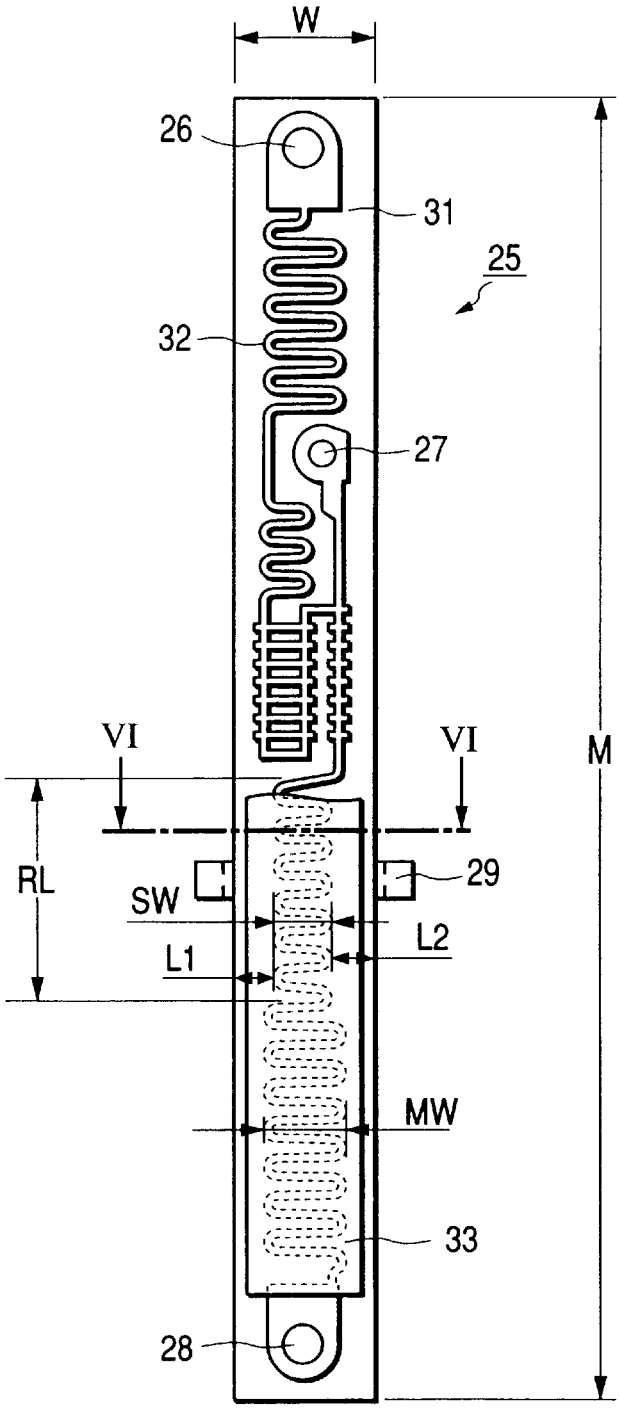
FIG. 5 is a partially broken-away top view of another embodiment of a voltage-dividing resistor used in the color cathode ray tube of the present invention.
Figure 6:
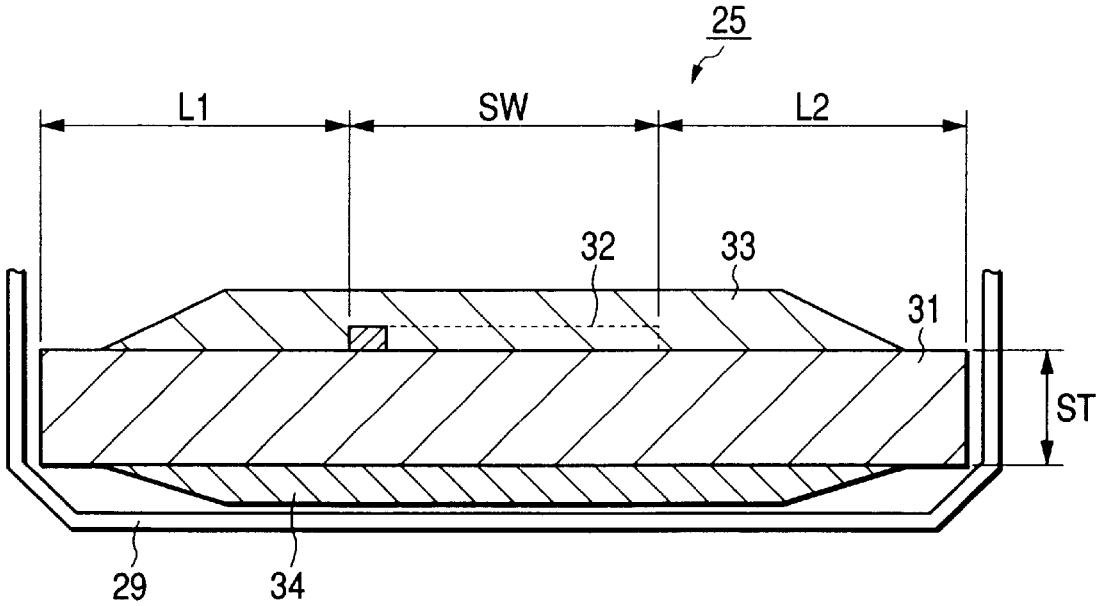
FIG. 6 is a cross-sectional view of the voltage-dividing resistor taken along line VI—VI of FIG. 5.

FIGS. 5 and 6 show the essential part of a voltage-dividing resistor 25 for explaining a second embodiment of a color cathode ray tube according to the present invention, FIG. 5 being a partially cut-away top view of the voltage-dividing resistor 25 and FIG. 6 being a cross-sectional view of the voltage-dividing resistor 25 taken along line VI—VI of FIG. 5. Like reference numerals as utilized in FIGS. 1–4 denote like or functionally similar parts in FIGS. 5 and 6.

The present embodiment is identical in structure with the previous embodiment, except that, even in the region of the resistance element 32 containing a portion thereof facing the shield wire 29 for suppression of discharge and having the axial length RL, the resistance element 32 meanders as in the remainder of the resistance element 32 as shown in FIG. 6. In this embodiment also, the intended object is achieved by selecting a width SW of meandering of the resistance element 32 such that the distances L1 and L2 between the resistance element 32 and the shield wire 29 is sufficient to prevent electric breakdown thereacross as considered in the previous embodiment. With this configuration, the overall resistance of the voltage-dividing resistor 25 can be increased.

The previous embodiments are provided with constricted portions of the resistance element 32 of the voltage-dividing resistor 25 in the region of the resistance element 32 containing a portion thereof facing the shield wire 29 for suppression of discharge and having the axial length RL, but the present invention is not limited to the configuration having the constricted portion.

Figure 7:
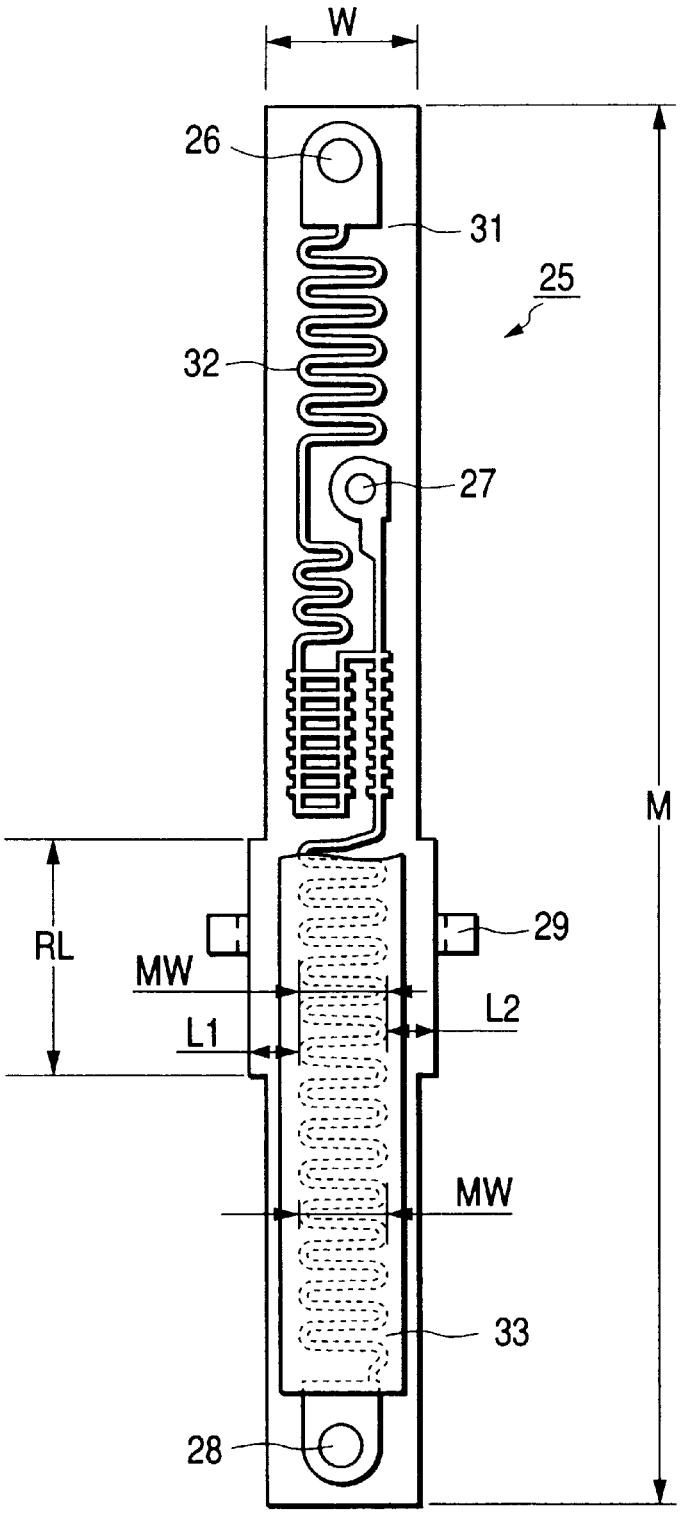
FIG. 7 is a partially broken-away top view of another embodiment of a voltage-dividing resistor used in the color cathode ray tube of the present invention.

FIG. 7 is a schematic partially broken-away front view of a voltage-dividing resistor 25 for explaining a third embodiment of a color cathode ray tube according to the present invention. In the region of the resistance element 32 containing a portion thereof facing the shield wire 29 for suppression of discharge and having the axial length RL, the width of meandering of the resistance element 32 is made equal to the width MW of meandering of the resistance element 32 in the remainder of the resistance element 32, without constricting the resistance element 32. Instead of local constriction of the resistance element 32, the region of the ceramic substrate 31 corresponding to the region of the resistance element 32 containing the portion thereof facing the shield wire 29 and having the axial length RL is made wider in a direction perpendicular to the cathode ray tube axis than the width W of the remainder of the ceramic substrate 31 such that the ceramic substrate 31 protrudes in the direction perpendicular to the tube axis and the minimum differences L1 and L2 between the resistance element 32 and the long sides of the ceramic substrate 31 extending in the direction of the tube axis are made larger in the region of the ceramic substrate 31 corresponding to the region of the resistance element 32 containing the portion thereof facing the shield wire 29 and having the axial length RL than those in the remainder of the ceramic substrate having the resistance element 32 thereon. With this configuration, the overall resistance of the voltage-dividing resistor 25 can be increased further.

In the previous embodiments, the overcoat glass film 33 formed on the side of the voltage-dividing resistor 25 facing the glass bead 23 is made thicker than the overcoat glass film 34 formed on the side of the voltage-dividing resistor 25 facing away from the glass bead 23. The present invention is also applicable to the case where the thickness of the overcoat glass film 33 is made smaller than or equal to the overcoat glass film 34.

The ceramic substrate 31 is fabricated by shaping $Al_2O_3$ paste into a desired shape of a desired size and firing it. The thus fabricated substrate 31 itself is porous in the strict sense and, consequently there is likelihood of local concentration of electric fields in the ceramic substrate 31. Therefore the overcoat glass film 34 is formed on the side of the ceramic substrate 31 opposite from the resistance element 32 so as to suppress arcing from the shield wire 29 on which electric charges are concentrated to the resistance element 32 and to thereby prevent the fracture of the voltage-dividing resistor 25 during the normal operation of the completed cathode ray tube.

When the thickness of the overcoat glass film 34 on the side of the ceramic substrate 31 facing away from the glass bead 23 is made larger than that of the overcoat glass film 33 formed on the side of the ceramic substrate 31 facing the glass bead 23, the creepage distance in the direction of the thickness ST of the ceramic substrate 31 between the resistance element 32 and the shield wire 29 is sufficiently secured to improve reliability of the voltage-dividing resistor 25 further. In that case, the thickness ST of the ceramic substrate 31 can be slightly reduced such that the cost of the material of the ceramic substrate can be reduced correspondingly.

The thermal expansion coefficient of the ceramic substrate 31 is different from those of the overcoat glass films 33 and 34. If the two overcoat glass films 33 and 34 on the respective surfaces of the ceramic substrate 31 are extremely unbalanced in thickness, the voltage-dividing resistor 25 is curved overall in the longitudinal direction specially during an evacuation step of the cathode ray tube requiring heating at a high temperature in the manufacture of the cathode ray tube and consequently, there is likelihood of degrading the precision of assembly of electrodes of the electron gun. Considering this, it is preferable that the overcoat glass film 34 is formed to a depth of a desired value on the surface of the ceramic substrate 31 opposite from the resistance element 32, and it is more preferable that the thickness of the overcoat glass film 34 is close to that of the overcoat glass film 33 formed on the resistance element 32 side of the ceramic substrate 31.

Figure 8:
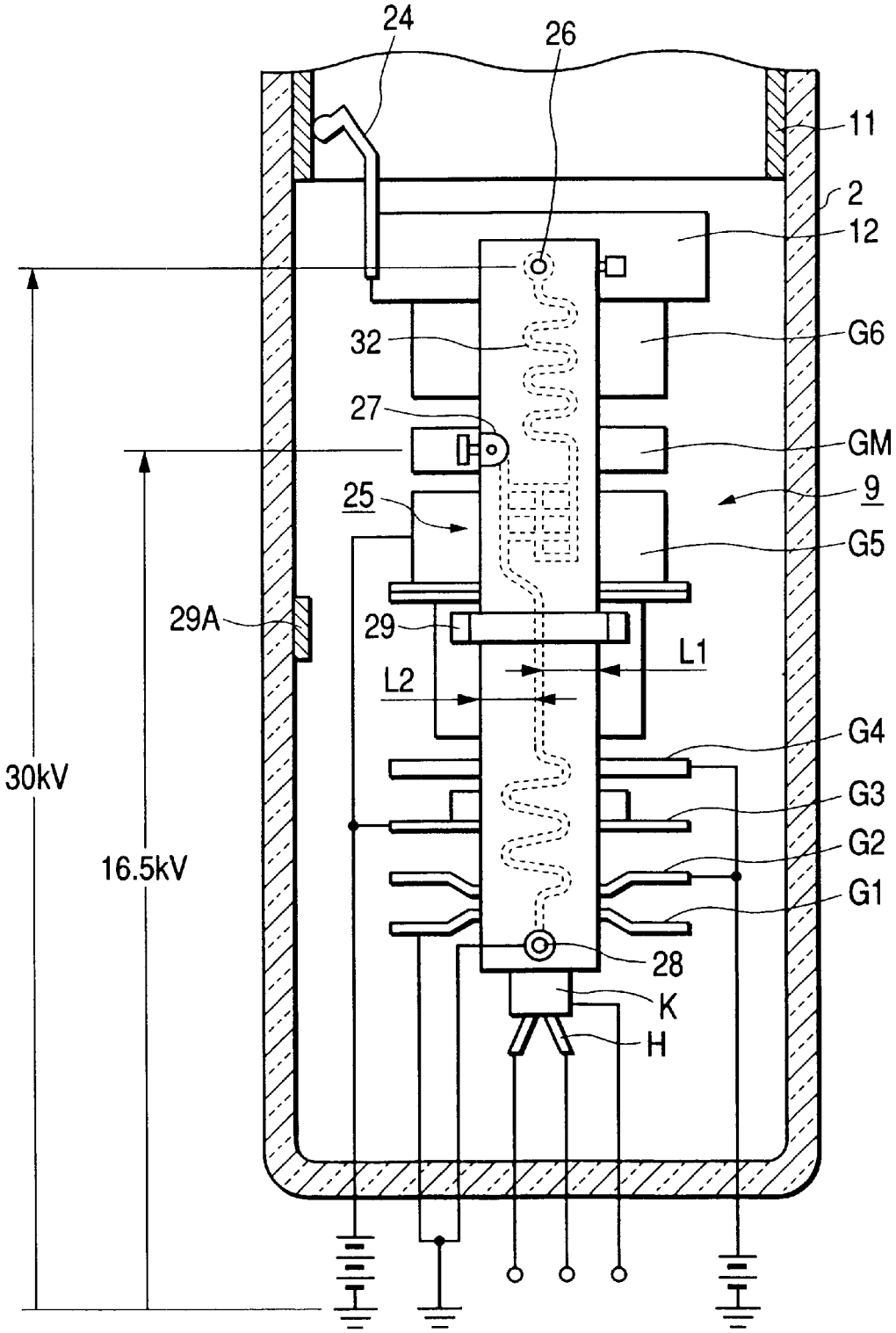
FIG. 8 is a schematic illustration of an electrical configuration for the color cathode ray tube of the present invention of FIG. 1 during operation.

FIG. 8 is a schematic illustration of an electrical configuration for the color cathode ray tube of the present invention of FIG. 1 during operation. The electrons emitted from the cathode K heated by the heater H are formed into a beam by the first grid electrode G1 (grounded) and the second grid electrode G2 (at 650 V for example), and then they are focused by the third grid electrode G3 (at 7 kV, for example), the fourth grid electrode G4, the fifth grid electrode G5, the intermediate electrode GM and the sixth grid electrode G6 (the anode electrode) to impinge upon the phosphor screen 4.

In the electron gun 9 of this type, the sixth grid electrode G6 is supplied with the anode voltage Eb, a highest voltage (30 kV, for example), the intermediate electrode GM is supplied with a voltage (16.5 kV corresponding to 55% of the anode voltage, for example) divided from the anode voltage Eb using the voltage-dividing resistor 25, the fifth grid electrode G5 and the third grid electrode G3 are connected together within the cathode ray tube and supplied with a same voltage (7 kV, for example), the fourth grid electrode G4 and the second grid electrode G2 are also connected together internally and are supplied with a direct voltage (650 V, for example), and the first grid electrode G1 is grounded. The cathodes K are supplied with video signals, respectively. The shield wire 29 for suppression of discharge is attached to the fifth grid electrode G5 as shown in FIG. 8.

The conductive film 29A for suppression of discharge is formed by evaporating a portion of metal contained in the shield wire 29 onto the inner wall of the neck portion 2 by heating the shield wire 29 using a high-frequency induction heater external to the neck portion 2, after the spot-knocking step.

In FIG. 8, L1 and L2 indicate creepage distances between the resistance element 32 and the shield wire 29 on the ceramic substrate 31 as in FIGS. 4 and 6.

Figure 9:
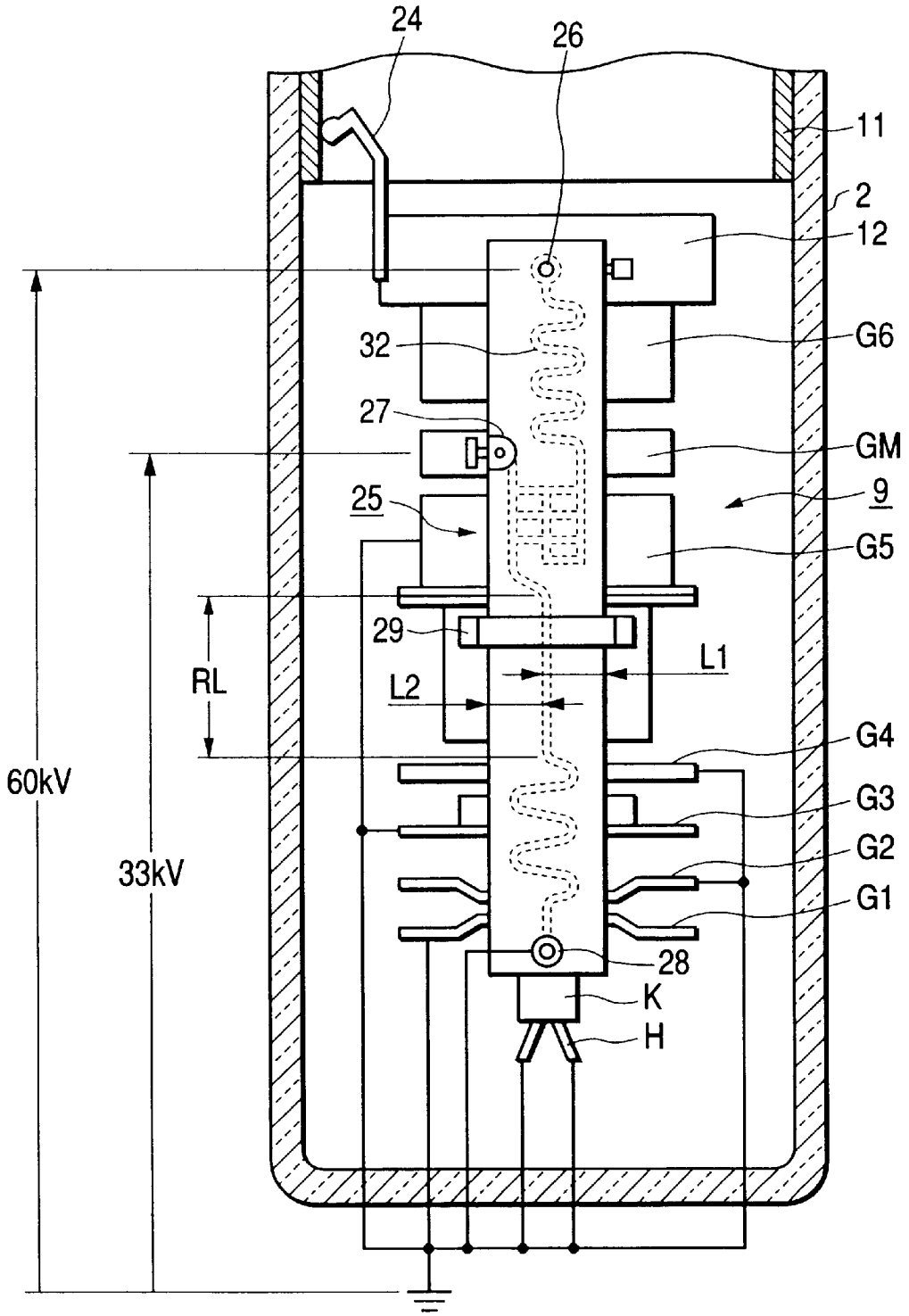
FIG. 9 is a schematic illustration of an electrical configuration for spot-knocking the color cathode ray tube of the present invention of FIG. 1.

The following explains the spot-knocking procedure. FIG. 9 is a schematic illustration of an electrical configuration for spot-knocking the color cathode ray tube of the present invention of FIG. 1 in the manufacturing steps. In the spot-knocking step, the conductive film 29A for suppression of discharge is not formed on the inner wall of the neck portion 2 yet, because the conductive film 29A would be dispersed in the spot-knocking step.

In FIG. 9, after the cathode ray tube has been exhausted of gases and sealed, all the electrodes except for the sixth grid electrode G6 and the intermediate electrode GM are grounded, a high voltage of 60 kV is applied to the sixth grid electrode G6, and a voltage of 33 kV divided from the high voltage of 60 kV via the voltage-dividing resistor 25 is applied to the intermediate electrode GM.

The purpose of the spot-knocking step is to remove projections in electrodes of the electron gun or foreign particles within the cathode ray tube by forcing arcing between the sixth grid electrode G6 and the intermediate electrode GM, between the intermediate electrode GM and the fifth grid electrode G5, the sixth grid electrode G6 and the inner wall of the neck portion 2, and between the intermediate electrode GM and the inner wall of the neck portion 2, by applying 27 kV and 33 kV between the sixth grid electrode G6 and the intermediate electrode GM, and between the intermediate electrode GM and the fifth electrode G5, respectively.

But during the spot-knocking procedure, the fifth grid electrode G5 to which the shield wire 29 for suppression of discharge is electrically connected is grounded and therefore a high voltage of about 30 kV is applied between the shield wire 29 and the resistance element 32 of the voltage-dividing resistor 25 surrounded by the shield wire 29. If the creepage distances L1 and L2 (see FIGS. 4, 6 and 7) between the resistance element 32 and the shield wire 29 on the ceramic substrate 31 are not large enough, arcing occurs and fractures the voltage-dividing resistor 25.

As a result, fragments broken off the overcoat glass film 33 or the ceramic substrate 31 of the voltage-dividing resistor 25 are dispersed within the vacuum envelope of the cathode ray tube, and are stuck in electron beam apertures in the shadow mask or adhere to the electrodes of the electron gun. They block electron beam apertures in the shadow mask and cause defective pixels in the phosphor screen, or they degrade withstand voltage characteristics of the cathode ray tube. Further, the resistance of the resistance element 32 of the voltage-dividing resistor 25 is changed such that the desired voltage difference is not obtained and consequently, arcing cannot be forced uniformly and the sufficient effect of the spot-knocking is not obtained.

In the cathode ray tube in accordance with the present invention, as shown in FIG. 9, in the region of the resistance element 32 containing a portion thereof facing the shield wire 29 and having the axial length RL, by making the width RW of the linear resistance element 32 as shown in FIG. 3 or the width SW of meandering resistance element 32 as shown in FIG. 5 narrower in the direction perpendicular to the cathode ray tube axis than the maximum width MW of meandering of the resistance element 32 in the remainder thereof, or by making the region of the ceramic substrate 31 corresponding to the region of the resistance element 32 containing the portion thereof facing the shield wire 29 and having the axial length RL wider in the direction perpendicular to the tube axis than the width W of the remainder of the ceramic substrate 31 as shown in FIG. 7, the sufficient creepage distances L1 and L2 between the resistance element 32 and the shield wire 29 on the ceramic substrate 31 is secured such that the withstand voltage between the resistance element 32 and the shield wire 29 is increased, occurrence of arcing is suppressed, and consequently, fracture of the voltage-dividing resistor 25 is prevented during the spot-knocking procedure.

As a result, 27 kV and 33 kV are applied between the sixth grid electrode G6 and the intermediate electrode GM and between the intermediate electrode GM and the fifth grid electrode G5, respectively, and sufficiently strong arcing is produced between the sixth grid electrode G6 and the intermediate electrode GM, between the intermediate electrode GM and the fifth grid electrode G5, the sixth grid electrode G6 and the inner wall of the neck portion 2, and between the intermediate electrode GM and the inner wall of the neck portion 2, resulting in sufficient removal of projections in electrodes of the electron gun or foreign particles within the cathode ray tube.

After the spot-knocking step, as shown in FIG. 2, the conductive film 29A for suppression of discharge during the normal operation of the completed cathode ray tube is formed on the inner wall of the neck portion 2 by evaporating a portion of metal contained in the shield wire 29 onto the inner wall of the neck portion 2 heating the shield wire 29 using a high-frequency induction heater external to the neck portion 2.

The present invention provides remarkable advantages especially when it is applied to a cathode ray tube having the neck portion 2 of an outside diameter smaller than the most widely used diameter of 29.1 mm at present. If the outside diameter of the neck portion 2 is reduced, the widths of the glass beads 23 for supporting the electrodes of the electron and the voltage-dividing resistor 25 as well as the outside diameter of the electrodes of the electron gun need to be reduced, and the distance of the glass bead 23 and the voltage-dividing resistor 25 traversed by the shield wire 29 is also reduced. But the width MW of meandering of the resistance element 32 cannot be reduced freely because reliability of the resistance element 32 must be secured.

The present invention has solved the problem with a reduced-neck diameter cathode ray tube having great potential of the voltage-dividing resistor 25 being fractured during the spot-knocking procedure, and provides a low-power cathode ray tube with its deflection power consumption being greatly reduced.

When the outside diameter of the neck portion is reduced, the lens diameter of the main focus lens of the electron gun is reduced and focusing characteristics of a displayed image tend to be deteriorated. But the present invention reduces or eliminates the deterioration in the focusing characteristics by forming a final stage of a main lens of the extended field type in which the intermediate electrode GM is disposed between the anode electrode (the sixth grid electrode G6) and the focus electrode (the fifth grid electrode G5) and the voltage intermediate between the sixth grid electrode 6 voltage and the fifth grid electrode G5 voltage is obtained by dividing the sixth grid electrode 6 voltage using the internal voltage-dividing resistor 25 housed within the cathode ray tube and is applied to the intermediate electrode GM.

Figure 10:
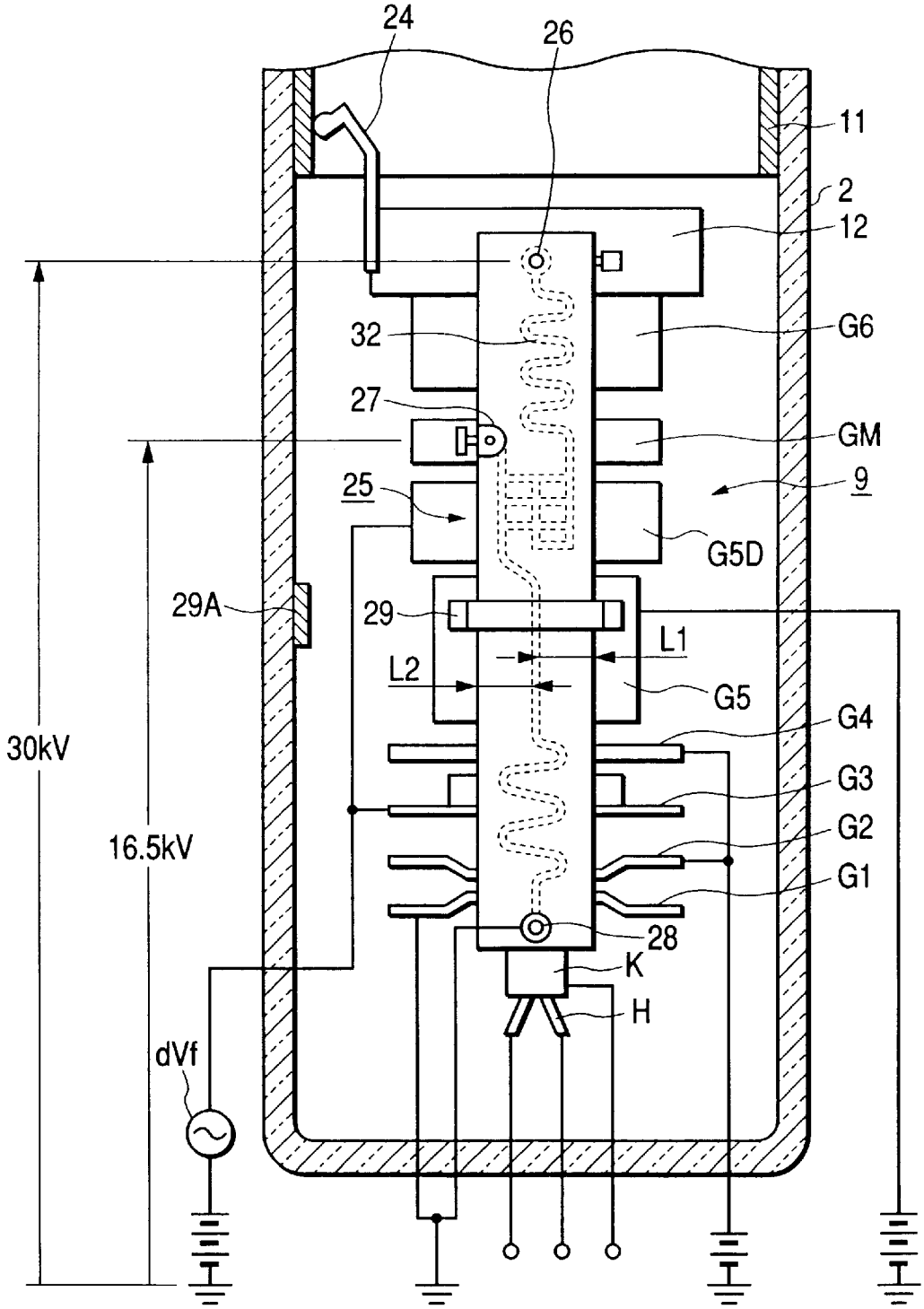
FIG. 10 is a partially broken-away front view of another embodiment of a color cathode ray tube according to the present invention.

FIG. 10 is a schematic configuration of an electron gun in another embodiment of a cathode ray tube according to the present invention. A fifth grid auxiliary electrode G5D is disposed between the intermediate electrode GM and the fifth grid electrode G5. The fifth grid auxiliary electrode G5D is supplied with a dynamic focus voltage of a fixed focus voltage (a direct voltage component) superposed with a dynamic voltage dvf increasing with increasing deflection of the electron beam such that an auxiliary lens the focusing action of which varies with deflection of the electron beam is formed between the final stage of the main lens of the extended field type and the preceding stage of the main lens comprised of the third to fifth grid electrodes G3 to G5 and focus characteristics at the periphery of the phosphor screen are further improved.

Figure 11:
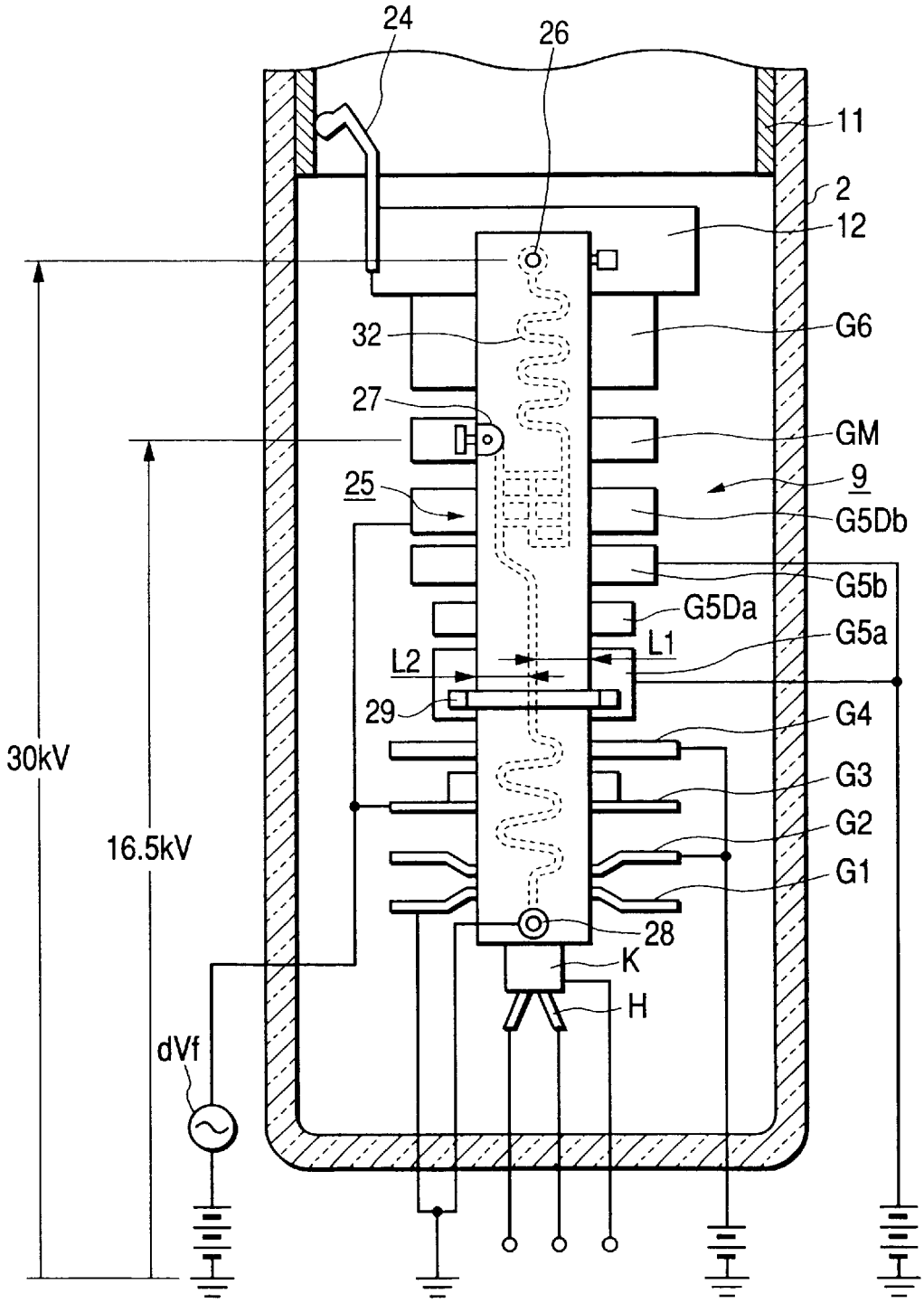
FIG. 11 is a partially broken-away front view of another embodiment of a color cathode ray tube according to the present invention.
Figure 12:
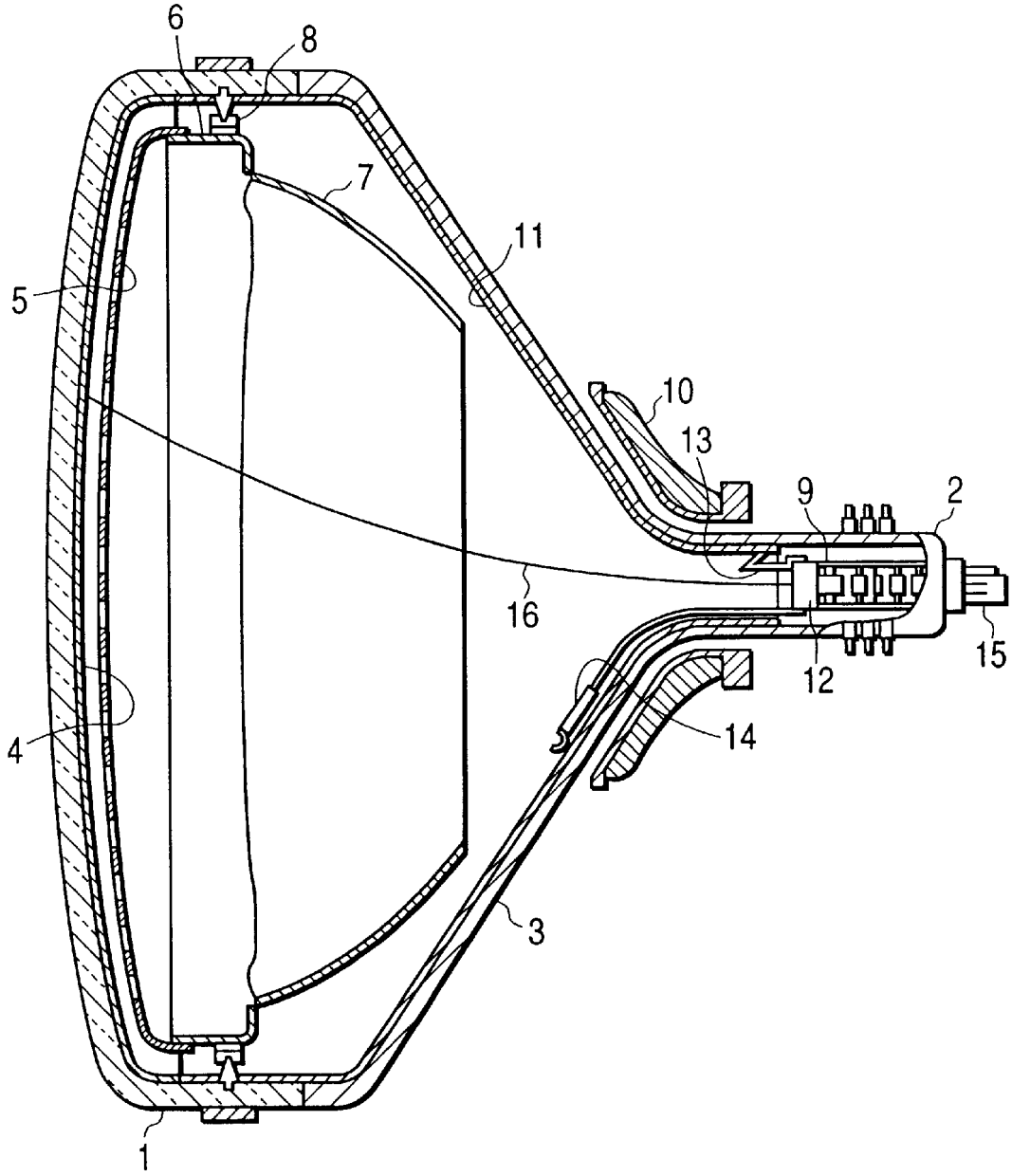
FIG. 12 PRIOR ART
FIG. 12 is a cross-sectional view of an exemplary prior art color cathode ray tube.
Figure 13:
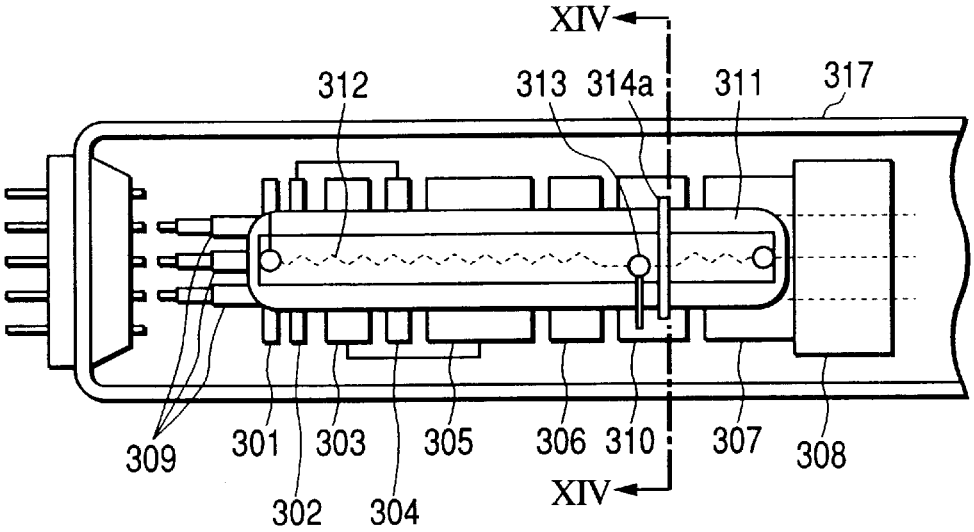
FIG. 13 PRIOR ART
FIG. 13 is a schematic longitudinal cross-sectional view of an electron gun of a prior art cathode ray tube and FIG. 14 is a cross-sectional view of the electron gun taken along line XIV—XIV of FIG. 13.
Figure 14:
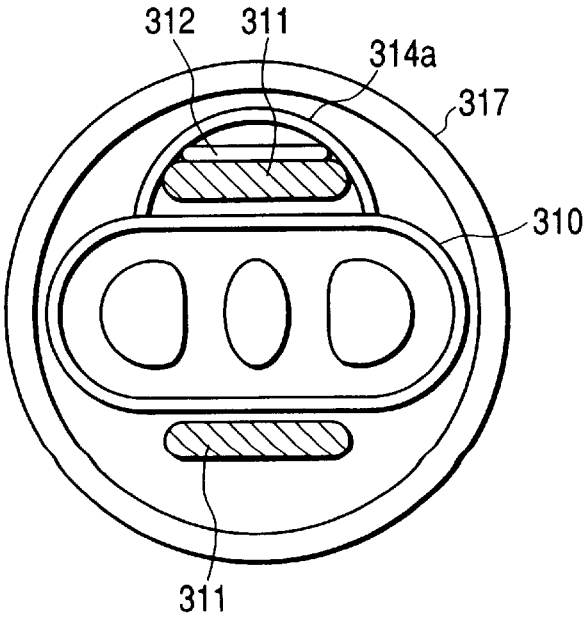
FIG. 14 PRIOR ART

FIG. 11 is a schematic configuration of an electron gun in still another embodiment of a cathode ray tube according to the present invention. The fifth grid electrode G5 is divided into a first member G5*a* and a second member G5*b*, and a fifth grid auxiliary electrode G5D is divided into a first member G5Da and a second member G5Db. The first and second members G5*a*, G5*b* of the fifth grid electrode and the first and second members G5Da, G5Db of the fifth grid auxiliary electrode are alternately arranged. The first and second members G5Da, G5Db of the fifth grid auxiliary electrode are supplied with a dynamic focus voltage of a fixed focus voltage (a direct voltage component) superposed with a dynamic voltage dvf increasing with increasing deflection of the electron beam such that a plurality of auxiliary lenses the focusing actions of which vary with deflection of the electron beam are formed between the final stage of the main lens of the extended field type and the preceding stage of the main lens comprised of the third to fifth grid electrodes G3 to G5 and the focus characteristics at the periphery of the phosphor screen are further improved.

It is preferable that one of said plurality of auxiliary lenses forms an electrostatic quadrupole lens for focusing the electron beam in one of horizontal and vertical directions and diverging the electron beam in the other of the horizontal and vertical directions with deflection of the electron beam so as to change the shape of the electron beam spot effectively and another of said plurality of auxiliary lenses forms an axially symmetric or non-axially symmetric lens for decreasing focusing action in both the horizontal and vertical directions with increasing deflection of the electron beam. The electrostatic quadrupole lens corrects astigmatism and the axially symmetric or non-axially symmetric lens corrects curvature of the image field.

It is preferable that the shield wire 29 for suppression of discharge is disposed as far away from the high-voltage terminal 26 and the intermediate-voltage terminal 27 as possible because the high-voltage terminal 26 and the intermediate-voltage terminal 27 of the resistance element 32 of the voltage-dividing resistor 25 are exposed. Therefore, if the shield wire 29 is attached to a point nearer to the end on the fourth grid electrode G4 side of a region containing the fifth grid electrode G5 (or a combination of the members G5*a* and G5*b* of the fifth grid electrode G5) and the fifth grid auxiliary electrode G5D (or a combination of the members G5Da and G5Db of the fifth grid auxiliary electrode G5D), than to the end on the intermediate electrode GM side of the region, the withstand voltages between the shield wire 29 and the high- and intermediate-voltage terminals 26, 27 are increased.

In the above embodiment in which the plural auxiliary lenses are formed by the alternate arrangement of the members G5*a* and G5*b* of the fifth grid electrode G5 and the members G5Da and G5Db of the fifth grid auxiliary electrode G5D, if the shield wire 29 is attached to the first member G5*a* of the fifth grid electrode G5 which is farthest from the intermediate-voltage terminal 27 among the members G5*a,* G5*b,* G5Da and G5Db and is adjacent to the fourth grid electrode G4, the withstand voltages between the shield wire 29 and the high- and intermediate-voltage terminals 26, 27 are increased.

Although the shield wire 29 is connected to the fifth grid electrode G5 in the previous embodiments, the similar advantages are also obtained by connecting the shield wire 29 to the third grid electrode G3. In this case, during the spot-knocking, a voltage difference between the resistance element 32 and the shield wire 29 is smaller compared with the case in which the shield wire 29 is connected to the fifth grid electrode, and consequently, the creepage distances L1 and L2 between the resistance element 32 and the shield wire 29 can be selected smaller than 2 mm.

The previous embodiments employ multi-stage main focus lens systems including a preceding stage of a main focus lens formed by the third to fifth grid electrodes G3 to G5 and a final stage of the main focus lens formed by the fifth to sixth grid electrodes G5 to G6, but the similar advantages are obtained by a configuration employing a single main focus lens system in which a main focus lens of the extended field type is formed by the third grid electrode G3, the fourth grid electrode G4 and the intermediate electrode GM disposed between the third and fourth grid electrodes G3, G4, the third grid electrode G3 is supplied with a focus voltage and the fourth grid electrode G4 is supplied with the anode voltage. In this case, if the shield wire 29 is fixed at a point of the third grid electrode G3 near the end thereof facing the second grid electrode G2, the withstand voltage between the resistance element 32 and the shield wire 29 is increased.

Further, the similar advantages are also obtained by a configuration of forming an auxiliary lens by disposing a third grid auxiliary electrode between the intermediate electrode GM and the third grid electrode G3 as in the previous embodiments employing the multi-stage main focus lens.

Further, the similar advantages are also obtained by a configuration of forming a plurality of auxiliary lenses by alternately arranging members of the third grid electrode G3 and members of the third grid auxiliary electrode as in the previous embodiment employing a multi-stage main focus lens system including plural auxiliary lenses.

In the above-explained embodiment, the present invention is applied to the three-beam in-line type electron gun, but it is needless to say that the present invention is also applicable to a one-beam electron gun.

In the above embodiments, the resistance element of the voltage-dividing resistor is shown as meandering in S shape, but the shape of meandering is not limited to the S shape in this specification, but the shape of meandering can be any shape including a V shape and a squared-C shape.

The present invention of the above-explained configuration heightens the effect of the spot-knocking by preventing occurrence of arcing between the resistance element of the voltage-dividing resistor supplied with a high voltage and the grounded metal conductor during the spot-knocking step and thereby improves the withstand voltage characteristics during the normal operation of the completed cathode ray tube.

What is claimed is:

1. A cathode ray tube comprising:

an evacuated envelope comprising a panel portion having a phosphor screen formed on an inner surface thereof, a neck portion and a funnel portion connecting said panel portion and said neck portion;

an electron gun housed in said neck portion comprising at least one cathode, a first grid electrode, a second grid electrode, a plurality of focus electrodes and an anode electrode arranged in the order named, said at least one cathode, said first grid electrode, said second grid electrode, said plurality of focus electrodes and said anode electrode being fixed in predetermined axially spaced relationship by at least two glass beads, said at least one cathode, said first grid electrode and said second grid electrode forming a triode section, and said plurality of focus electrodes and said anode electrode forming a focus lens for focusing at least one electron beam emitted from said triode section on said phosphor screen;

a voltage-dividing resistor attached to a surface of one of said at least two glass beads for producing an intermediate voltage to be applied to a first one of said plurality of focus electrodes adjacent to said anode electrode by dividing a voltage applied to said anode electrode, said surface of said one of said at least two glass beads facing an inner wall of said neck portion; and a metal conductor facing and attached to one of electrodes forming said triode section and said focus lens to surround said voltage-dividing resistor and said one of said at least two glass beads, said one of electrodes being disposed upstream of said first one of said plurality of focus electrodes;

said voltage-dividing resistor comprising an overcoat insulating film, a resistance element and an insulating substrate stacked in the order named from said overcoat insulating film facing said one of said at least two glass beads, and said resistance element comprising first-type resistance-forming regions disposed on opposite sides of said metal conductor and a second-type resistance-forming region containing a portion thereof facing said metal conductor, said resistance element in said first-type resistance-forming regions extending meanderingly in a direction of a cathode ray tube axis, said resistance element in said second-type resistance-forming region being configured such that minimum distances L1 and L2 between said resistance element and two long sides of said insulating substrate extending in the direction of the cathode ray tube axis, respectively, are larger than corresponding minimum distances between said resistance element and two long sides of said insulating substrate extending in the direction of the cathode ray tube axis in said first-type resistance-forming regions.

2. The cathode ray tube according to claim 1, wherein said metal conductor is connected to a second one of said plurality of focus electrodes.

3. The cathode ray tube according to claim 2, wherein said metal conductor is connected to a point of said second one of said plurality of focus electrodes nearer to an end thereof facing toward said at least one cathode than an end thereof facing toward said first one of said plurality of focus electrodes.

4. The cathode ray tube according to claim 1, wherein said second-type resistance-forming region is constricted in a direction perpendicular to the cathode ray tube axis compared with said first-type resistance-forming regions.

5. The cathode ray tube according to claim 4, wherein said resistance element is in a form of a line extending in the direction of the cathode ray tube axis in said second-type resistance-forming region.

6. The cathode ray tube according to claim 4, wherein said resistance element extends meanderingly in the direction of the cathode ray tube axis in said second-type resistance-forming region.

7. The cathode ray tube according to claim 1, wherein an area of said insulating substrate corresponding to said second-type resistance-forming region protrudes in a direction perpendicular to the cathode ray tube axis compared with areas of said insulating substrate corresponding to s aid first-type resistance-forming regions.

8. The cathode ray tube according to claim 1, wherein said minimum distances L1 and L2 are at least 2 mm.

9. The cathode ray tube according to claim 8, wherein said second-type resistance-forming region extends a distance of at least 4 mm in the direction of the cathode ray tube axis.

10. The cathode ray tube according to claim 1, wherein an outside diameter of said neck portion is smaller than 29.1 mm.

11. A cathode ray tube comprising:

an evacuated envelope comprising a panel portion having a phosphor screen formed on an inner surface thereof, a neck portion and a funnel portion connecting said panel portion and said neck portion;

an electron gun housed in said neck portion comprising at least one cathode, a first grid electrode, a second grid electrode, a third grid electrode, a fourth grid electrode, a fifth grid electrode, an intermediate electrode and a sixth grid electrode arranged in the order named and fixed in predetermined axially spaced relationship by at least two glass beads, said at least one cathode, said first grid electrode and said second grid electrode forming a triode section, and said third grid electrode, said fourth grid electrode, said fifth grid electrode, said intermediate electrode and said sixth grid electrode forming a focus lens for focusing at least one electron beam emitted from said triode section on said phosphor screen said sixth grid electrode being supplied with an anode voltage, said fifth grid electrode and said third grid electrode being electrically connected together and supplied with a focus voltage lower than said anode voltage, said fourth grid electrode and said second grid electrode being electrically connected together and supplied with an accelerating voltage lower than said focus voltage;

a voltage-dividing resistor attached to a surface of one of said at least two glass beads for producing an intermediate voltage to be applied to said intermediate electrode by dividing said anode voltage, said surface of said one of said at least two glass beads facing an inner wall of said neck portion; and a metal conductor facing and attached to one of electrodes forming said triode section and said focus lens to surround said voltage-dividing resistor and said one of said at least two glass beads, said one of electrodes being disposed upstream of said intermediate electrode;

said voltage-dividing resistor comprising an overcoat insulating film, a resistance element and an insulating substrate stacked in the order named from said overcoat insulating film facing said one of said at least two glass beads, and said resistance element comprising first-type resistance-forming regions disposed on opposite sides of said metal conductor and a second-type resistance-forming region containing a portion thereof facing said metal conductor, said resistance element in said first-type resistance-forming regions extending meanderingly in a direction of a cathode ray tube axis, said resistance element in said second-type resistance-forming region being configured such that minimum distances L1 and L2 between said resistance element and two long sides of said insulating substrate extending in the direction of the cathode ray tube axis, respectively, are larger than corresponding minimum distances between said resistance element and two long sides of said insulating substrate extending in the direction of the cathode ray tube axis in said first-type resistance-forming regions.

12. The cathode ray tube according to claim 11, wherein said metal conductor is connected to said fifth grid electrode.

13. The cathode ray tube according to claim 12, wherein said metal conductor is connected to a point of said fifth grid electrode nearer to an end thereof facing toward said at least one cathode than an end thereof facing toward said intermediate electrode.

14. The cathode ray tube according to claim 11, wherein said second-type resistance-forming region is constricted in a direction perpendicular to the cathode ray tube axis compared with said first-type resistance-forming regions.

15. The cathode ray tube according to claim 14, wherein said resistance element is in a form of a line extending in the direction of the cathode ray tube axis in said second-type resistance-forming region.

16. The cathode ray tube according to claim 14, wherein said resistance element extends meanderingly in the direction of the cathode ray tube axis in said second-type resistance-forming region.

17. The cathode ray tube according to claim 11, wherein an area of said insulating substrate corresponding to said second-type resistance-forming region protrudes in a direction perpendicular to the cathode ray tube axis compared with areas of said insulating substrate corresponding to said first-type resistance-forming regions.

18. The cathode ray tube according to claim 11, wherein said minimum distances L1 and L2 are at least 2 mm.

19. The cathode ray tube according to claim 18, wherein said second-type resistance-forming region extends a distance of at least 4 mm in the direction of the cathode ray tube axis.

20. The cathode ray tube according to claim 11, wherein an outside diameter of said neck portion is smaller than 29.1 mm.

* * * * *